US007384541B2

(12) United States Patent
Charron et al.

(10) Patent No.: US 7,384,541 B2
(45) Date of Patent: Jun. 10, 2008

(54) USE OF A TWO-PHASE TURBINE IN A HYDROTREATMENT PROCESS

(75) Inventors: Yves Charron, Longport sur Orge (FR); Béatrice Fischer, Lyons (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 384 days.

(21) Appl. No.: 10/909,430

(22) Filed: Aug. 3, 2004

(65) Prior Publication Data

US 2005/0029165 A1 Feb. 10, 2005

(30) Foreign Application Priority Data

Aug. 4, 2003 (FR) ..... 03 09620

(51) Int. Cl.
*C10G 45/00* (2006.01)
*F02C 6/00* (2006.01)

(52) U.S. Cl. ..... 208/212; 208/209; 60/791; 60/774

(58) Field of Classification Search ..... 208/212, 208/209; 60/791, 774
See application file for complete search history.

(56) References Cited

U.S. PATENT DOCUMENTS 5,515,694 A * 5/1996 Meloling et al. ..... 62/197
6,620,311 B2 * 9/2003 Morel et al. ..... 208/57

FOREIGN PATENT DOCUMENTS

| | | |
|---|---|---|
| EP | 1041243 A2 | 10/2000 |
| FR | 2333139 | 6/1977 |
| FR | 2665224 | 1/1992 |
| GB | 2346936 | 8/2000 |

OTHER PUBLICATIONS

English translation of Preliminary Search Report; pp. 1-2: Apr. 23, 2004.

* cited by examiner

*Primary Examiner*—Glenn Caldarola
*Assistant Examiner*—John C Douglas
(74) *Attorney, Agent, or Firm*—Antonelli, Terry, Stout & Kraus, LLP.

(57) ABSTRACT

After passing into reaction section R, the hydrocarbon feedstock C mixed with hydrogen H is expanded in device D. The expansion is brought about by a single-phase turbine until a gas volume ratio of 5% is reached, then expansion is brought about in a two-phase turbine of the rotodynamic type.

13 Claims, 2 Drawing Sheets

USE OF A TWO-PHASE TURBINE IN A HYDROTREATMENT PROCESS

The invention relates to the field of hydrotreatment. It proposes the use of a two-phase turbine in a hydrotreatment process.

Hydrotreatment processes are used in particular by the oil industry for treating petroleum effluents in combination with hydrogen. For example, hydrocracking consists of converting heavy hydrocarbons into light hydrocarbons and hydrorefining attempts mainly to remove the sulfur, nitrogen, and/or metal impurities contained in the hydrocarbon feedstock.

In general, a hydrotreatment method involves catalytic reactors, processing units, and tanks. Depending on the function of the tanks in the process, they can be at a high pressure (approximately 10 MPa), at a low pressure (between approximately 0.5 and 1 MPa), at a high temperature (between approximately 250° C. and 300° C.), or at a low temperature (approximately 50° C.). The pipes connecting a high-pressure tank to a low-pressure tank are provided with an expansion valve. The expansion valve enables the pressure of the fluid transferred by the pipes to be reduced. Press relief is carried out at constant enthalpy and without energy recovery.

The goal of the invention is to recover the expansion energy in hydrotreatment processes.

In general, the invention relates to a hydrotreatment method having the following steps:

a) A fluid having a liquid volume ratio greater than or equal to 95% and having a pressure P1 is expanded by a single-phase turbine to obtain a fluid with a gas volume ratio less than or equal to 5% and having a pressure P2, b) Said fluid having a gas volume ratio less than or equal to 5% and having a pressure P2 is expanded by a two-phase turbine to obtain a fluid with a pressure P3.

According to the invention, the two-phase turbine can be a rotodynamic turbine.

The single-phase turbine and the two-phase turbine can form a single machine having at least one impeller and at least one distributor of single-phase design and at least one impeller and at least one distributor of two-phase design. The single-phase design and two-phase design hydraulics can be mounted on the same shaft.

The hydrotreatment method according to the invention can include the following steps:

c) Before step a), part of the high-pressure fluid is withdrawn, d) Said part of said high-pressure fluid is expanded by means of a first device.

The hydrotreatment method according to the invention can also include the following step or steps:

e) Before step a), said high-pressure fluid is expanded by means of a second device.

f) After step b), said low-pressure fluid is expanded by means of a third device.

According to the invention, one of said first, second, and third devices can be an expansion valve or a turbine.

One advantage of the present invention is the ability to recover energy in a hydrotreatment process. The energy is recovered when a fluid expands through a turbine. The turbine shaft can also be connected to the shaft of a pump or a compressor to compress a fluid. The energy recovered at the turbine shaft can also be converted into electrical energy.

The features and advantages of the invention will emerge more clearly from reading the description below of non-limiting exemplary embodiments, with reference to the drawings.

Figure 1:
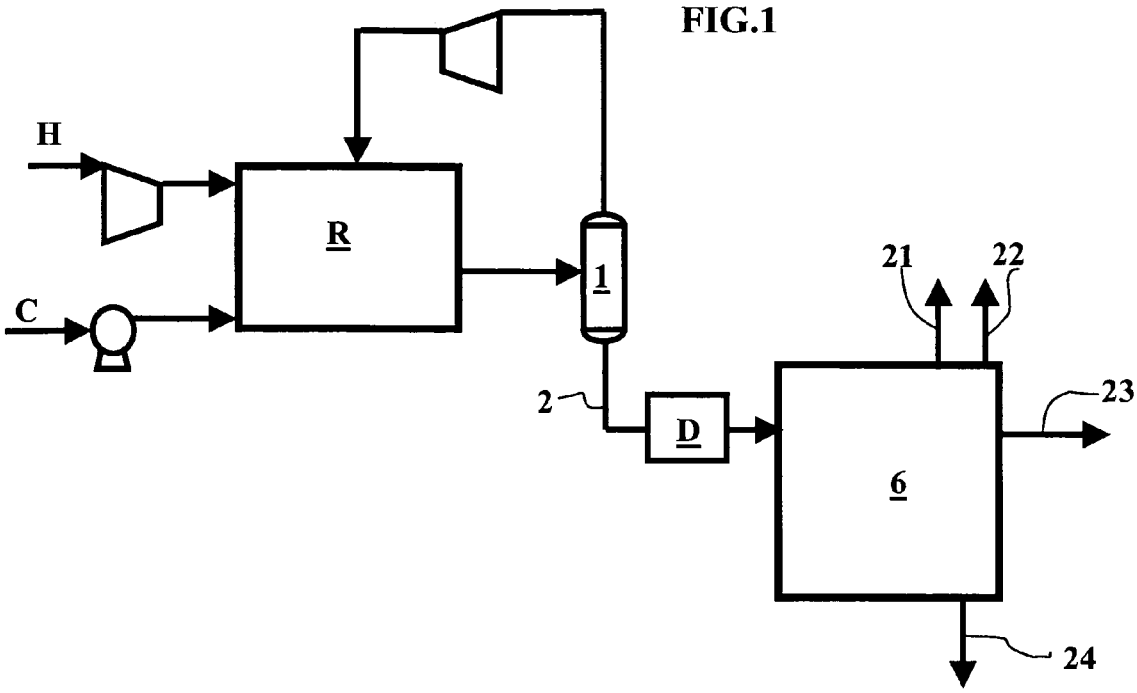
FIG. 1 shows a hydrotreatment process schematically.

FIG. 1 shows a hydrotreatment process schematically. Feedstock C includes hydrocarbons, for example distillates under vacuum, diesel fuel coming from a conversion process, and/or deasphalted residues. This feedstock C is pumped into the reaction section R. Hydrogen H is necessary for carrying out the hydrotreatment reactions. The hydrogen H is compressed so that it can also be introduced into the reaction section R. The reaction section R may consist of one or more reactors, not shown, at a high temperature (for example between 350° C. and 450° C.) and at a high pressure (for example between 5 MPa and 20 MPa). The effluent coming from the reaction section R is sent to a separator tank 1 in which the liquid and vapor phases are separated, at a temperature far below the temperature of the reaction section R. The vapor phase coming from separator 1 is sent by means of a compressor to the reaction section R to ensure that the hydrogen partial pressure is sufficient there. The liquid phase in tank 1 bubbles at a pressure generally between 5 and 20 MPa. This liquid phase contains essentially hydrocarbons: the heavy hydrocarbons in the feedstock, lighter hydrocarbons produced by cracking reactions in reaction section R, a small amount of dissolved hydrogen, and a small amount of sulfuretted hydrogen from desulfurizing reactions in reaction section R. This liquid is evacuated from tank 1 via pipe 2 to device D in which it is expanded before being sent to low-pressure section 6 for fractionation of the reaction products. The stabilized products are evacuated by pipe 24, for example to a storage area. Section 6 also enables combustible gas evacuated by pipe 21, and possibly liquified petroleum gas evacuated by pipe 22 (propane and butane), and possibly gasoline evacuated by pipe 23 to be obtained. The latter three products generally contain sulfuretted hydrogen. Section 6 is subjected to a pressure of 0.5 to 1.5 MPa at a low temperature (for example between 20° C. and 100° C.).

Figure 2:
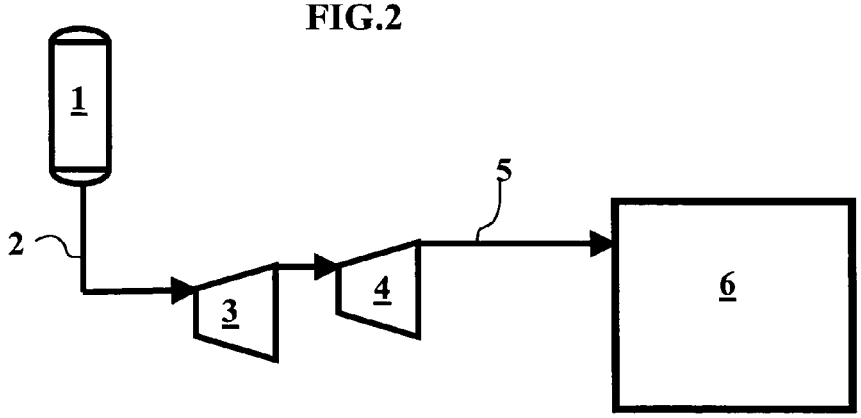
FIG. 2 shows the method according to the invention schematically.
Figure 4:
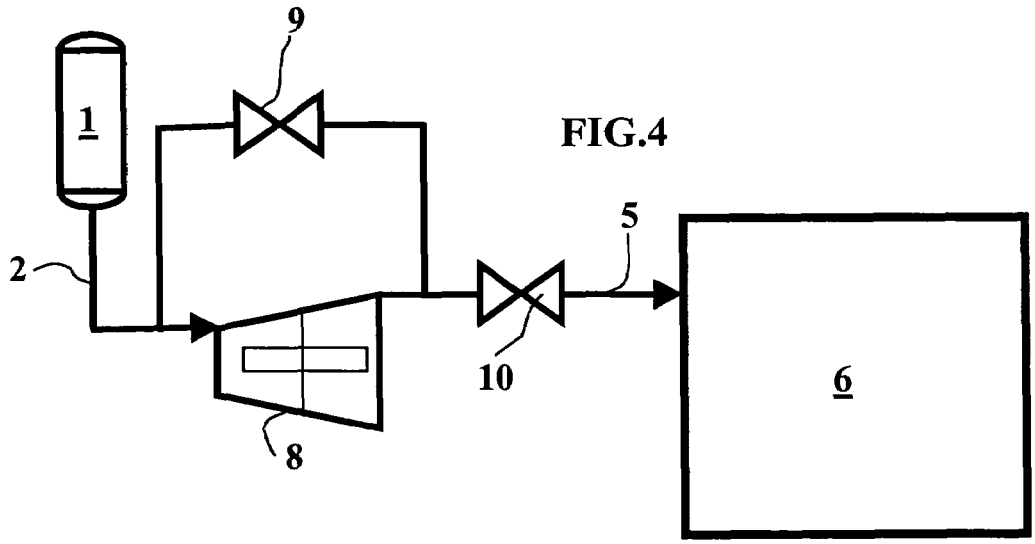

The invention, shown in detail in FIGS. 2 and 4, sets out to improve recovery of the energy generated by the expansion in device D.

In FIG. 2, separator tank 1 and low-pressure section 6 are the elements of a facility for implementing a hydrotreatment process as described in FIG. 1. The other elements of the facility are not shown.

Tank 1 contains a high-pressure fluid. Pipe 2 brings the fluid from tank 1 to single-phase turbine 3. The fluid conveyed by pipe 2 has a liquid volume ratio of over 95%. In turbine 3, the fluid is expanded until the gas volume ratio of the fluid reaches 5%. Beyond a gas volume ratio of 5%, a single-phase turbine can no longer be used without risk of deterioration. The fluid obtained after expansion in turbine 3 is brought to two-phase turbine 4 where it is expanded to the pressure prevailing in the low-pressure section 6. Pipe 5 brings the fluid from turbine 4 to section 6.

In the present description, a single-phase turbine refers to a turbine designed to expand a fluid having a gas volume ratio less than 5%. Single-phase turbine 3 can be a turbine of the rotodynamic type, for example a machine with distributors and impellers constituting Francis-type hydraulics, or a volumetric type turbine. At the exit of a single-phase turbine (for example a multistage turbine, i.e. a turbine having several pairs of distributors and impellers) the expanded fluid must have a gas volume ratio of less than 5%. If the fluid is expanded such that it contains more than 5% gas by volume, not only is there a risk of damage to the single-phase turbine but the efficiency of the single-phase turbine drops dramatically. When a fluid with a gas volume ratio less than 5% is expanded, a single-phase turbine has an efficiency of over 50%.

In the present description, a two-phase turbine refers to a turbine designed to expand a fluid having a gas volume ratio greater than 5%. Two-phase turbine 4 can be a rotodynamic turbine having impellers and distributors, for example a machine such as that described in one of the following patents: FR 2,333,139, FR 2,471,5401, and FR 2, 665,224. When a fluid with a gas volume ratio greater than 5% is expanded, a two-phase turbine has over 50% efficiency with no risk of turbine deterioration.

The following examples indicate the energy recovered using the device described with reference to FIG. 2.

EXAMPLE 1

Tank 1 at 10 MPa and 50° C.

Section 6 at 1.2 MPa

Throughput 176 t/hour (i.e. 44 kg/sec)

170 kW is recovered in turbine 3 until the fluid reaches a gas volume ratio of approximately 5%, then 300 kW is recovered in turbine 4.

EXAMPLE 2

Tank 1 at 10.3 MPa and 260° C.

Section 6 at 0.6 MPa

Throughput 229 t/hour (i.e. 56 kg/sec)

200 kW is recovered in turbine 3 until the fluid reaches a gas volume ratio of approximately 5%, then 650 kW is recovered in turbine 4.

Figure 3:
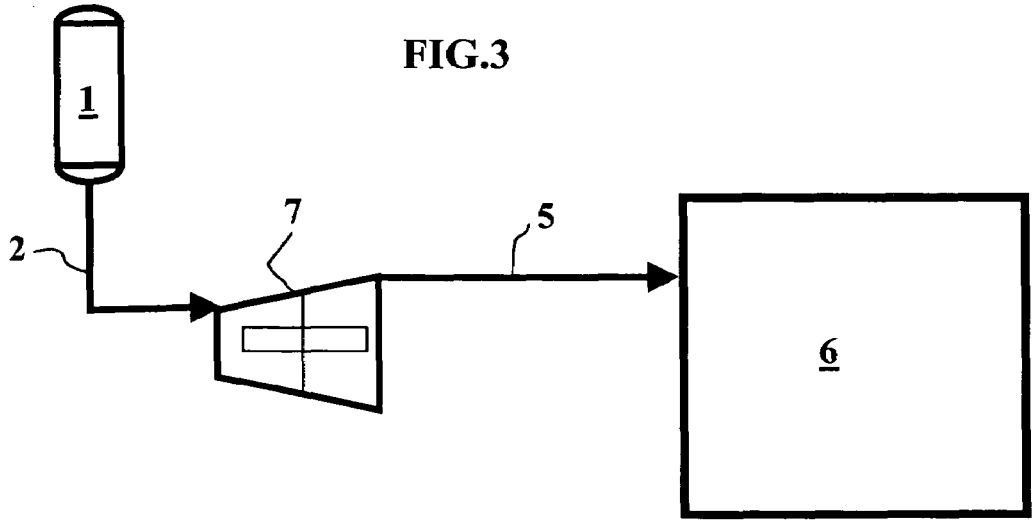
FIGS. 3 and 4 show variants of the method according to the invention.

The reference numerals in FIGS. 3 and 4 that are identical with the reference numerals in FIG. 2 designate identical elements.

The variant of the method according to the invention shown in FIG. 3 sets out to combine the single-phase and two-phase turbines into a single turbine 7. Turbine 7 is a rotodynamic machine having impellers and distributors of single-phase design at the inlet and impellers and distributors of two-phase design at the outlet. The impellers and distributors are contained in the same housing. The single-phase and two-phase impellers can be mounted on the same shaft. The fluid to be expanded, coming from tank 1, is introduced into turbine 7 by pipe 2. In turbine 7, the fluid acts first on the impellers and distributors of single-phase design until a gas volume ratio of 5% is reached, then on the impellers and distributors of two-phase design until the pressure of section 6 is reached. At the outlet of turbine 7, the fluid is brought to section 6 by pipe 5.

The method shown schematically in FIG. 4 sets out to expand a fluid coming from high-pressure tank 1 in a turbine 8, the expanded fluid being introduced into the low-pressure section 6. Turbine 8 can consist either (as described with reference to FIG. 2) of a single-phase turbine followed by a two-phase turbine, or of a single machine (as described with reference to FIG. 3) having impellers and distributors constituting single-phase and two-phase hydraulics. A first valve 9 is disposed in parallel with turbine 8. A second valve 10 is disposed in series with turbine 8. Second valve 10 may be disposed upstream or downstream of turbine 8.

Valve 10 is used to reduce the expansion in turbine 8 in the case of a very large pressure release, i.e. in the case of a large difference between the pressure of tank 1 and that of section 6. Turbine 8 releases the pressure of the high-pressure fluid down to an intermediate pressure, then valve 10 releases the intermediate-pressure fluid down to the low pressure prevailing in section 6. The intermediate pressure has a value between that of the high pressure in tank 1 and the low pressure in section 6.

Valve 9 is used to reduce the flowrate of the fluid circulating through turbine 8. Some of the fluid coming from tank 1 is released by valve 9, and the remainder of the fluid coming from tank 1 is released by turbine 8.

Valves 9 and 10 may be replaced by turbines.

The invention claimed is:

1. Hydrotreatment method comprising the following steps:

reacting a feedstock comprising hydrocarbons with hydrogen in a reaction section to obtain an effluent comprising reaction products at a pressure P1 between 5 and 20 MPa, separating the effluent into a fluid phase comprising gas and a fluid phase comprising liguid, expanding the fluid phase comprising liquid by a single-phase turbine to obtain a fluid with a gas volume ratio less than or equal to 5% and having a pressure P2 lower than the pressure P1, expanding the fluid having the gas volume ratio less than or equal to 5% and having the pressure P2 by a two-phase turbine to obtain a fluid with a pressure P3 between 0.5 and 1.5 MPa, and sending the fluid having the pressure P3 to a fractionation section for fractionation of the reaction products.

2. Hydrotreatment method according to claim 1, wherein the two-phase turbine is a rotodynamic turbine.

3. Hydrotreatment method according to claim 2, wherein the single-phase turbine and the two-phase turbine form a single machine having at least one impeller and at least one distributor of single-phase design and at least one impeller and at least one distributor of two-phase design.

4. Hydrotreatment method according to claim 3, wherein hydraulics for said single-phase design and two-phase design are mounted on the same shaft.

5. Hydrotreatment method according to claim 1, further comprising the following steps:

before the step of expanding the fluid phase comprising liguid, withdrawing part of the fluid phase comprising liquid, and expanding said part by means of an expansion device.

6. Hydrotreatment method according to claim 1, further comprising the following step:

before the step of expanding the fluid phase comprising liquid, expanding said fluid phase comprising liguid by means of an expansion device.

7. Hydrotreatment method according to claim 1, further comprising the following step:

after the step of expanding the fluid having the gas volume ratio less than or equal to 5% and having the pressure P2, expanding said fluid having the gas volume ratio less than or equal to 5% and having the pressure P2 by means of an expansion device.

8. Hydrotreatment method according to claim 5, wherein the expansion device is an expansion valve.

9. Hydrotreatment method according to claim 5, wherein the expansion device is a turbine.

10. Hydrotreatment method according to claim 6, wherein the expansion device is an expansion valve.

11. Hydrotreatment method according to claim 6, wherein the expansion device is a turbine.

12. Hydrotreatment method according to claim 7, wherein the expansion device is an expansion valve.

13. Hydrotreatment method according to claim 7, wherein the expansion device is a turbine.

* * * * *